US006840048B2

(12) United States Patent
Han et al.

(10) Patent No.: US 6,840,048 B2
(45) Date of Patent: Jan. 11, 2005

(54) DYNAMICALLY UNCOUPLED CAN COMBUSTOR

(75) Inventors: Fei Han, Schenectady, NY (US); Osman Saim Dinc, Troy, NY (US); Abdul-Azeez Mohammed-Fakir, Guilderland, NY (US); Sung Jin Kim, Guilderland, NY (US)

(73) Assignee: General Electric Company, Niskayuna, NY (US)

( * ) Notice: Subject to any disclaimer, the term of this patent is extended or adjusted under 35 U.S.C. 154(b) by 119 days.

(21) Appl. No.: 10/255,114

(22) Filed: Sep. 26, 2002

(65) Prior Publication Data

US 2004/0060298 A1 Apr. 1, 2004

(51) Int. Cl.[7] ..... F02C 3/14; F02C 7/24

(52) U.S. Cl. ..... 60/772; 60/39.37; 60/725

(58) Field of Search ..... 60/39.37, 725, 60/752, 772, 800; 415/139, 141

(56) References Cited

U.S. PATENT DOCUMENTS

| | | | | | |
|---|---|---|---|---|---|
| 2,475,911 | A | * | 7/1949 | Nathan | 60/39.37 |
| 2,540,642 | A | * | 2/1951 | Allen et al. | 60/39.37 |
| 3,327,473 | A | * | 6/1967 | Smith | 60/39.37 |
| 5,644,918 | A | | 7/1997 | Gulati et al. | |
| 6,192,688 | B1 | | 2/2001 | Beebe | |

* cited by examiner

*Primary Examiner*—Louis J. Casaregola
(74) *Attorney, Agent, or Firm*—Patrick K. Patnode; Christian G. Cabou

(57) ABSTRACT

Respective combustion gas streams are generated in a can combustor. The streams are channeled downstream into an annular turbine nozzle. And, dynamic interaction of circumferentially adjacent combustion gas streams is suppressed axially between the cans and the nozzle.

5 Claims, 3 Drawing Sheets

DYNAMICALLY UNCOUPLED CAN COMBUSTOR

BACKGROUND OF THE INVENTION

The present invention relates generally to gas turbine engines, and, more specifically, to combustors therein.

In a gas turbine engine, air is pressurized in a compressor and mixed with fuel in a combustor for generating hot combustion gases that flow downstream through turbine stages which extract energy therefrom. A high pressure turbine follows the combustor and extracts energy for powering the compressor. And, a low pressure turbine follows the high pressure turbine and extracts additional energy for powering an external load, such as an electrical generator in an exemplary embodiment.

Large industrial power generation gas turbine engines typically include a can combustor having a row of individual combustor cans in which combustion gases are separately generated and collectively discharged into a common high pressure turbine nozzle for redirection into the first stage of turbine rotor blades. Each combustor can is generally cylindrical and has an aft transition section or piece configured for changing the flowpath from circular to a corresponding arcuate portion of an annulus. In this way, the row of cans have corresponding arcuate outlets adjoining each other circumferentially at a common plane defining a segmented annulus for discharging the combustion gases into the common turbine nozzle.

Each combustor can has a corresponding combustor liner in which the combustion gases are bound, with an upstream dome end of the liner having several premixers in which fuel is injected and mixed with air for forming fuel and air mixtures which undergo combustion. Each can generates a corresponding combustion gas stream independently from the other cans, with the several streams being collectively discharged into the common turbine nozzle.

A significant design objective in combustor performance is the dynamic operation thereof. The combustion gases have a corresponding static pressure in each can, and a dynamic pressure response associated with different dynamic modes of response. Combustors are typically designed for minimizing undesirable resonant dynamic response which could lead to fatigue damage in the combustors and adversely affect combustor performance.

Since the can combustors are independent and discrete components, each generating its respective combustion gas stream, the static and dynamic operation of the cans are inter-related at the outlet ends of the combustors and the inlet end of the common turbine nozzle.

Typically, the leading edges of the turbine nozzle vanes are spaced aft from the outlet ends of the combustor cans to provide a common annulus in which the several gas streams are initially discharged into the nozzle. In this way, any differences in static pressure from can to can may be reduced or eliminated by the common annulus for improving performance of the engine.

However, the common annulus provides a mechanism for dynamic interaction between the adjoining cans which may lead to undesirable modal resonance. More specifically, two distinctive types of combustion dynamic modes are known in can combustors. In a push-pull mode of dynamic response, the dynamic pressure in adjoining cans may be out-of-phase; and in a push-push mode of dynamic response, dynamic pressures may have the same phase. These dynamic modes occur at a specific frequency, with resonant modes having elevated dynamic pressure amplitudes, and non-resonant modes having little or no pressure amplitudes or affect.

In general, push-pull modes of dynamic response generate higher pressure amplitudes, and therefore may lead to fatigue damage and adverse performance of the combustor. Correspondingly, push-push modes of dynamic response have little interaction between the cans and do not promote fatigue damage or adversely affect combustor performance.

Accordingly, it is desired to provide an improved can combustor in which push-pull modes of dynamic response are reduced or eliminated for improving combustor performance and correspondingly reducing fatigue damage.

BRIEF DESCRIPTION OF THE INVENTION

Respective combustion gas streams are generated in a can combustor. The streams are channeled downstream into an annular turbine nozzle. And, dynamic interaction of circumferentially adjacent combustion gas streams is suppressed axially between the cans and the nozzle.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
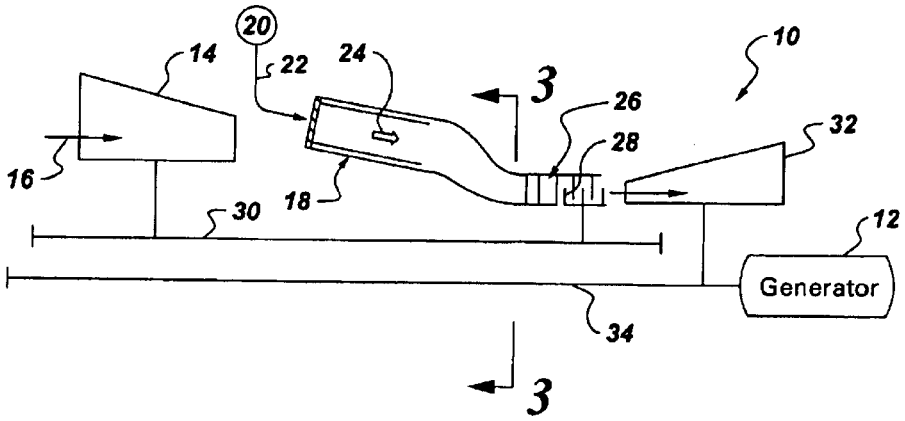
FIG. 1 is a schematic axial sectional view of an industrial power generation gas turbine engine having a can combustor in accordance with an exemplary embodiment of the present invention.

Illustrated schematically in FIG. 1 is an industrial power generation gas turbine engine 10 configured for driving an electrical generator 12 in an exemplary embodiment. The engine includes a multistage axial compressor 14 configured for pressurizing air 16.

Disposed downstream from the compressor is an annular can combustor 18 which suitably receives the pressurized air from the compressor. Conventional means 20 including corresponding fuel injectors are provided for injecting fuel 22, such as natural gas, into the combustor for mixing with the compressed air which is ignited for generating a stream 24 of combustion gases which is discharged from the combustor into an annular high pressure turbine nozzle 26.

The turbine nozzle directs the combustion gases into one or more stages or rows of high pressure turbine rotor blades 28 which extract energy from the combustion gases for rotating the rotor blades of the compressor 14 through a corresponding drive shaft 30 extending therebetween. In the exemplary embodiment illustrated in FIG. 1, there are three rows of high pressure rotor blades in the high pressure turbine, with corresponding second and third stage turbine nozzles.

A multistage low pressure turbine 32 is disposed downstream from the high pressure turbine and is joined to another drive shaft 34 which in turn is joined to the generator for providing the rotary power thereto.

But for the particular configuration of the can combustor 18 and cooperating first stage turbine nozzle 26, the engine illustrated in FIG. 1 may be otherwise conventional in configuration and function for driving the electrical generator.

Figure 2:
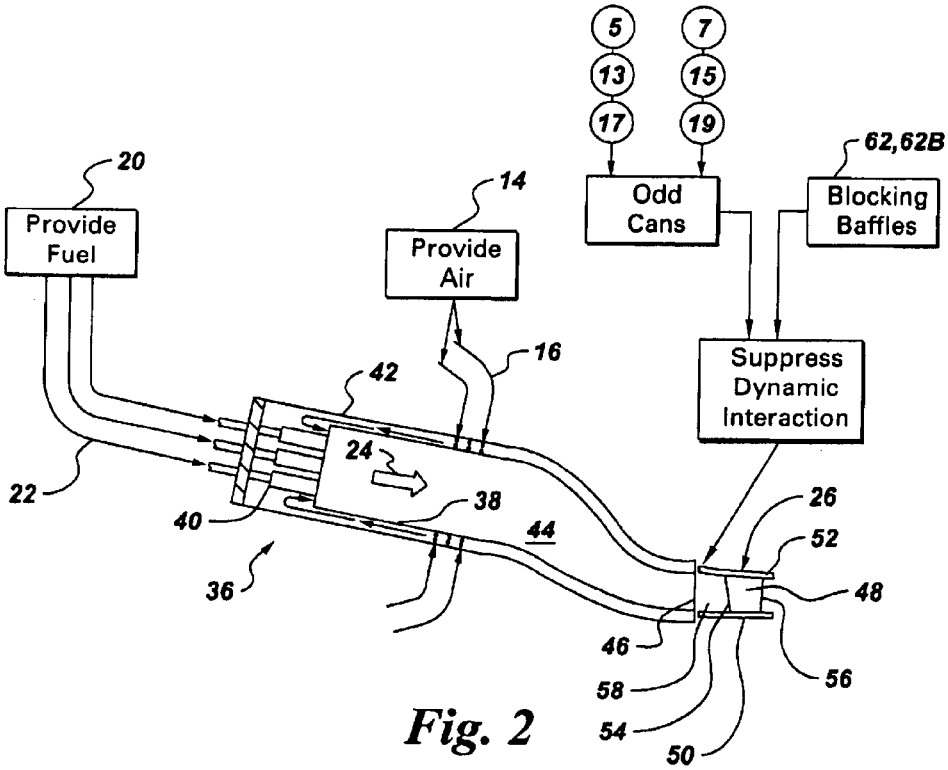
FIG. 2 is a schematic axial sectional view of one of the combustor cans illustrated in FIG. 1 discharging a combustion gas stream into a downstream annular turbine nozzle.

FIG. 2 illustrates in axial cross section an exemplary combustor can 36 of the combustor illustrated in FIG. 1. The combustor can is conventional and includes an annular combustor liner 38 having an upstream dome end at which are located several premixers 40, for example five. Each premixer has a corresponding fuel injector for injecting natural gas, for example, into the premixer for being mixed with a portion of the compressed air 16, which mixture is suitably ignited for generating the combustion gas stream 24 inside the combustor liner.

Surrounding the combustor liner is an annular shroud or casing 42 which defines an annular manifold around the liner through which the compressed air 16 is channeled in a conventional manner for both cooling the liner itself, as well as providing air to the premixers.

Figure 3:
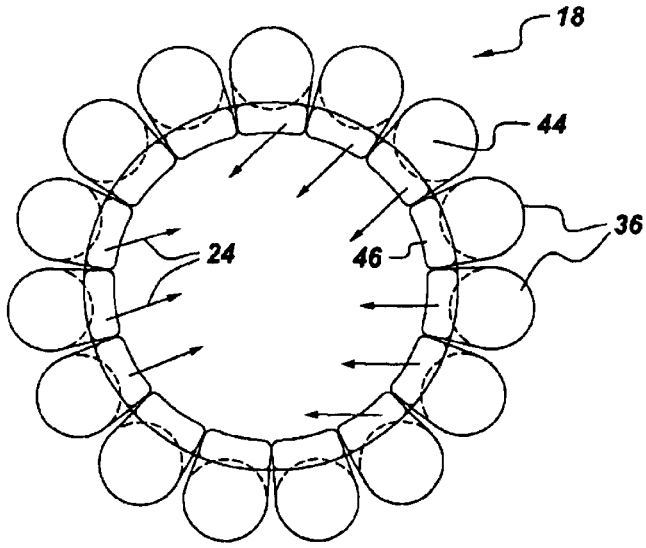
FIG. 3 is a radial sectional aft-facing-forward view of the can combustor illustrated in FIG. 1 and taken along line 3—3.

The overall combustor 18 illustrated in FIG. 1 is annular and is generally symmetrical about the longitudinal or axial centerline axis of the engine, and includes a row of substantially identical combustor cans 36 as illustrated in axial section in FIG. 2, and illustrated in aft-looking-forward view in FIG. 3. Since each combustor liner 38 is generally cylindrical or circular in radial section, each combustor can 36 further includes an integral transition piece 44 which terminates in a corresponding arcuate outlet 46 best illustrated in FIG. 3. The transition piece outlets 46 from the corresponding combustor cans adjoin each other around the perimeter of the combustor to define a segmented annulus for collectively discharging the separate combustion gas streams 24 into the common first stage turbine nozzle 26 illustrated in FIG. 2.

The engine as described above including the can combustor 18 and its cooperation with the turbine nozzle 26 is conventional in configuration and function. As indicated above in the background section, each combustor can generates its own stream of combustion gases having corresponding static and dynamic pressure performance. Furthermore, since the multiple combustor cans adjoin each other at the common turbine nozzle 26, dynamic interaction of the adjoining cans is subject to the push-push and push-pull dynamic modes of interaction described above.

In accordance with the present invention, the engine 10 illustrated in FIG. 1 is suitably modified for suppressing or eliminating the dynamic pressure interaction between adjacent cans in the can combustor 18 for specifically suppressing the push-pull out-of-phase dynamic interaction modes. Correspondingly, combustor performance may be enhanced while reducing or eliminating fatigue damage therefrom.

As initially shown in FIG. 2, each can in the row of combustor cans is suitably provided with fuel 22 and compressed air 16 for generating their respective combustion gas streams 24 in parallel. The multiple streams are discharged through the arcuate outlets 46 of the corresponding transition pieces 44 in a common axial plane as illustrated in FIGS. 2 and 3.

The several streams 24 are collectively channeled downstream into the common annular turbine nozzle 26 as shown in FIG. 2. The turbine nozzle is conventional in configuration in one embodiment and includes a plurality of stator vanes 48 fixedly mounted radially between inner and outer bands 50,52. Each of the vanes is preferably hollow for channeling cooling air therethrough, and includes an upstream leading edge 54 and a downstream trailing edge 56 between which extend the pressure and suction sides of the vane.

Since the several combustor cans collectively discharge their respective gas streams into the common turbine nozzle 26, the dynamic interaction of the circumferentially adjacent streams may be conveniently suppressed axially between the multiple cans and common single nozzle 26.

Combustion of the fuel and air mixture creates in the corresponding combustion gas streams 24 both static pressure, and dynamic pressure represented by periodic pressure oscillations in the streams. The periodic pressure oscillations are frequency specific and vary in magnitude from zero for non-resonant frequencies to elevated pressure amplitudes for resonant frequencies.

As described in further detail hereinbelow, dynamic interaction of the adjacent gas streams 24 is preferably suppressed by suppressing the out-of-phase dynamic interaction of the streams discharged from the cans, which corresponds with the push-pull dynamic modes.

As illustrated in FIG. 2, the stator vanes 48 are preferably spaced downstream from the combustor cans 36 to define an annular manifold or annulus 58 disposed axially between the transition piece outlets 46 and the vane leading edges 54. The manifold is circumferentially continuous around the centerline axis of the engine and provides a common annulus into which all of the combustion gas streams 24 from all of the combustor cans may be collectively discharged.

Discharge of the multiple streams in the common manifold is effective for balancing static pressure between the adjacent cans for improving engine performance. However, the common manifold 58 also provides a mechanism for dynamic interaction between the combustor cans.

Such dynamic interaction in the can combustor may be suppressed or eliminated in accordance with one embodiment of the present invention by operating the combustor with an odd number of combustor cans 36.

For example, power generation gas turbine engines manufactured by the present assignee include can combustors with an even number of total combustor cans such as 6 cans, 14 cans, and 18 cans for different engine models. An even number of combustor cans has been historically used for maintaining the circumferential symmetry of combustor performance.

Instead of using an even number of total combustor cans in the engine, an odd number of total cans may be used for suppressing dynamic mode interaction between the cans The use of an odd number of cans may be greater than or less than the corresponding even number of total cans by only one. In other words, 13 or 15 cans may be used in one model, 17 or 19 cans may be used in another model, and 5 or 7 cans may be used in the third model for comparison purposes.

The simple use of an odd number of cans as opposed to the conventional even number of cans has been analyzed for supporting the suppression of dynamic mode interaction between the cans. The undesirable push-pull mode of dynamic interaction may be characterized as alternating plus and minus phase relationship between any two adjoining cans.

As indicated above, dynamic modes are frequency specific with corresponding periodic pressure oscillations which are sinusoidal waveforms. The peaks of the waveforms may be considered the positive or plus (+) value, with the troughs or valleys being the corresponding minus (−) values.

When adjoining combustor cans dynamically interact in the push-pull mode, the plus value in one can is in phase with the minus value in an adjacent can at a corresponding frequency.

Empirical test data for a conventional even-can combustor indicates a push-pull mode of dynamic interaction at about a first frequency, with the next resonant mode of interaction being a push-push mode at a higher second frequency. The amplitude of pressure oscillation substantially decreases with an increase in frequency mode.

Analytical simulation of the even-can combustor predicts exemplary two modes of dynamic interaction. And, analytical simulation of a corresponding odd-number can combustor confirms the suppression for substantial elimination of the push-pull dynamic mode of interaction at the first frequency.

Since push-pull dynamic interaction requires out of phase correspondence from can to can, the push-pull dynamic interaction mode may be suppressed or eliminated by changing the geometry of the can combustor to prevent continuity of the out of phase interaction.

By analogy, out of phase interaction requires alternating plus and minus phase relationship from can to can around the perimeter of the combustor, which is structurally permitted by the use of an even number of combustor cans. By simply changing the number of combustor cans to the closest odd number of cans, the circumferential continuity of the alternating plus and minus phase interaction between the cans can be eliminated. With an odd number of cans, two adjoining cans must necessarily be in phase, notwithstanding the geometric alternating phase between the remaining cans. By interrupting the circumferential continuity of the alternating phases, the push-pull mode of dynamic interaction can be effectively suppressed or eliminated as supported by the analytical data.

FIG. 3 illustrates one embodiment of the can combustor illustrated in FIG. 1 which is otherwise conventional except for the use of an odd number of combustor cans, with fifteen (15) cans being illustrated. FIG. 2 illustrates schematically alternative configurations of the odd-can combustor variations of the conventional 6 can, 14 can, and 18 can combustor having one more or less combustor can for a total of 5, 7, 13, 15, 17, or 19 cans in the entire combustor.

For a given gas turbine engine size, reducing the number of combustor cans will correspondingly require increase in size of the cans for producing the same amount of work. And, increasing the number of cans will require a corresponding reduction in the size of the cans for producing the same work from the engine.

As indicated above, the odd-can combustor may cooperate with the conventional first stage turbine nozzle 26 illustrated in FIG. 2 in which the several combustion gas streams are collectively discharged into the common annular manifold 58. The common manifold ensures balancing of the static pressure between the multiple cans, with dynamic interaction of the push-pull modes being suppressed by the odd number of combustor cans. The odd-cans are therefore effectively dynamically uncoupled from each other for suppressing the push-pull modes of operation with minimal change to the engine design.

Figure 4:
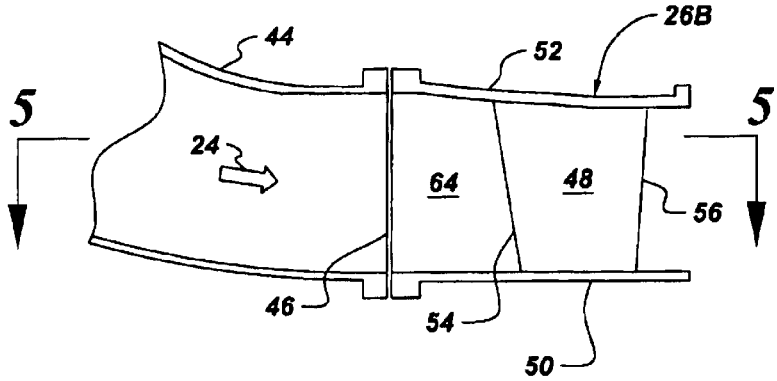
FIG. 4 is an enlarged axial sectional view of the high pressure turbine nozzle illustrated in FIG. 1 in accordance with an alternate embodiment of the present invention.

FIG. 4 illustrates an alternate embodiment of the present invention for suppressing the push-pull dynamic interaction of the combustor cans. In this embodiment, the number of combustor cans may remain even as in conventional practice so that the design thereof need not change. Dynamic interaction of the even number of cans is suppressed by suitably blocking circumferential crossflow of the adjacent combustion gas streams 24 between the cans and the nozzle vanes 48.

Figure 5:
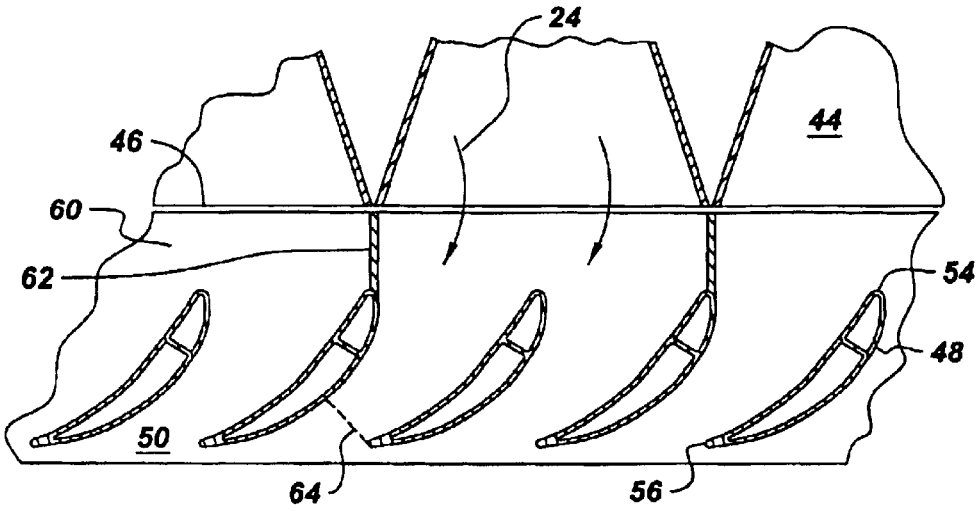
FIG. 5 is a planiform sectional view through the turbine nozzle illustrated in FIG. 4 at the outlet of the can combustor and taken along line 5—5.

As shown in FIGS. 4 and 5, the vanes 48 are spaced downstream from the outlet ends of the cans to define a circumferentially extending plenum 60. The turbine nozzle illustrated in FIG. 4 is designated 26B and is a modification of the substantially identical turbine nozzle 26 illustrated in FIG. 2.

In this embodiment of the turbine nozzle illustrated in FIGS. 4 and 5, the plenum 60 is circumferentially segmented by corresponding imperforate baffles 62 extending axially downstream from adjoining transition pieces 44 to corresponding leading edges 54 of the vanes 48. The baffles 62 may be integrally formed with the inner and outer bands 50, 52 of the turbine nozzle and are correspondingly aligned with the circumferential junctures between adjoining transition pieces 44. Since a turbine nozzle typically includes more vanes than the number of transition pieces, there are fewer baffles than there are vanes, with the baffles being provided solely at the junction of adjoining transition pieces at their outlets to substantially block the otherwise open flow area therebetween and prevent circumferential crossflow and dynamic coupling between the adjoining combustor cans.

In this way, crossflow between the combustor cans may be blocked in the segmented plenum 60 from the outlets of the transition pieces to the corresponding leading edges of the vanes.

Further analysis of this embodiment indicates the suppression of the push-pull dynamic interaction modes as the amount of open area circumferentially between the can outlets is reduced. The baffles 62 may be sized and configured for blocking a portion or substantially all of the otherwise open area between the adjoining combustor cans for directing the combustion gas streams directly between the corresponding vanes downstream of the respective combustor cans.

In the exemplary embodiment illustrated in FIG. 5, the baffles 62 are axially and radially straight, and adjoin corresponding leading edges of the respective vanes. Whereas the vanes have aerodynamic profiles including a generally concave pressure side and a generally convex suction side, the baffles 62 may simply be straight for blocking the open area between the can outlets.

Figure 6:
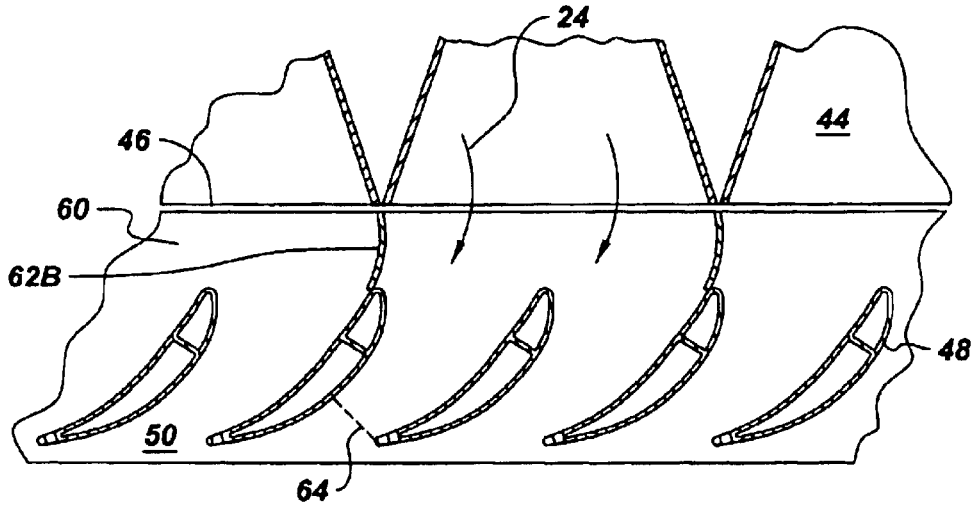
FIG. 6 is a planiform view, like FIG. 5, of the turbine nozzle in accordance with an alternate embodiment of the present invention.

FIG. 6 illustrates an alternate embodiment of the baffles, designated 62B, which are axially arcuate, and radially straight. In this embodiment, the arcuate baffles 62B have a concave side which suitably blends with the concave side of a corresponding vane just aft of the leading edge thereof, and a convex side which generally matches the convex side of the corresponding vane.

The shape or configuration of the baffles 62, 62B may be optimized as desired for blocking the crossflow open area between the can outlets while maximizing aerodynamic performance of the turbine nozzle.

As shown in FIG. 5, the nozzle vanes 48 may have any conventional configuration and typically define a throat 64 of minimum flow area between the trailing edge of one vane extending normal to a corresponding point on the suction side of an adjacent vane. During operation, the combustion gases experience choked flow at the throat, and therefore the baffles are effective for dynamically uncoupling the combustor cans upstream from the nozzle throats for suppressing the push-pull dynamic interaction modes.

Similarly, performance of the odd number of combustor cans described above is interrelated upstream from the nozzle throats so that the simple use of the odd number of cans suppresses the creation of the undesirable push-pull dynamic interaction modes.

A particular advantage of the embodiments disclosed above is that the odd-can combustor or baffled turbine nozzle may be readily retrofittable into a pre-existing power generation turbine for suppressing the push-pull dynamic modes and improving both fatigue life and performance. Dynamic simulation of the basic embodiments disclosed above supports the suppression of the push-pull dynamic interaction modes. And, further development of the embodiments may be conducted for optimizing performance thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A method of suppressing dynamic interaction in a gas turbine combustor comprising:

providing fuel and air to a row of combustor cans for generating respective streams of combustion gases therein, with each of said cans having a transition piece terminating in an arcuate outlet for discharging said streams in a common plane;

channeling said streams downstream into an annular turbine nozzle having a plurality of vanes mounted radially between inner and outer bands, with each of said vanes having an upstream leading edge and a downstream trailing edge; and suppressing dynamic interaction of circumferentially adjacent streams of said combustion gases axially between said cans and nozzle;

wherein said streams are generated in an odd number of said cans greater than or less than fourteen, sixteen eighteen cans by only one.

2. A method according to claim 1 wherein:

each of said cans is operated to generate periodic pressure oscillations in said streams; and dynamic interaction of said streams is suppressed by suppressing out-of-phase dynamic interaction of said streams discharged from said cans.

3. A method according to claim 2 wherein:

said vanes are spaced downstream from said cans to define an annular manifold axially between said transition piece outlets and said vane leading edges; and said streams are discharged from said cans in common into said manifold for balancing static pressure between adjacent cans.

4. An apparatus comprising:

a combustor including a row of combustor cans for generating respective streams of combustion gases therein, with each of said cans having a transition piece terminating in an arcuate outlet for discharging said streams in a common plane;

means for providing fuel and air to said cans for generating said combustion gases;

an annular turbine nozzle disposed in flow communication with said cans for receiving said streams therefrom, and including a plurality of vanes mounted radially between inner and outer bands, with each of said vanes having an upstream leading edge and a downstream trailing edge; and means for suppressing dynamic interaction of circumferentially adjacent streams of said combustion gases axially between said cans and nozzle;

wherein said number of cans is greater than or less than fourteen, sixteen or eighteen cans by only one.

5. An apparatus according to claim 4 wherein:

said vanes are spaced downstream from said cans to define an annular manifold axially between said transition piece outlets and said vane leading edges; and said streams are discharged from said cans in common into said manifold for balancing static pressure between adjacent cans.

* * * * *